US005647266A

United States Patent [19]

Claas

[11] Patent Number: 5,647,266

[45] Date of Patent: Jul. 15, 1997

[54] HOLD-DOWN MECHANISM FOR HYDRAULIC PUMP

[75] Inventor: Anthony M. Claas, Waukesha, Wis.

[73] Assignee: Dynex/Rivett, Inc., Pewaukee, Wis.

[21] Appl. No.: 568,565

[22] Filed: Dec. 7, 1995

Related U.S. Application Data

[63] Continuation-in-part of Ser. No. 317,213, Oct. 3, 1994, Pat. No. 5,490,444.

[51] Int. Cl.[6] ..... F01B 3/00

[52] U.S. Cl. ..... 92/71; 91/505; 417/222.1; 417/269

[58] Field of Search ..... 92/70, 71; 91/490, 91/499, 505; 417/222.1, 222.2, 269, 554

[56] References Cited

U.S. PATENT DOCUMENTS

| | | | |
|---|---|---|---|
| 2,445,281 | 7/1948 | Rystrom . | |
| 2,612,837 | 10/1952 | Midgette . | |
| 2,672,095 | 3/1954 | Lucien et al. . | |
| 2,675,759 | 4/1954 | Yarger . | |
| 2,819,678 | 1/1958 | Nordell et al. . | |
| 2,821,932 | 2/1958 | Lucien . | |
| 2,918,879 | 12/1959 | Cervo . | |
| 3,183,847 | 5/1965 | Raymond . | |
| 3,208,395 | 9/1965 | Budzich | 91/505 X |
| 3,357,363 | 12/1967 | Raymond . | |
| 3,413,929 | 12/1968 | Cook et al. . | |
| 3,514,223 | 5/1970 | Hare . | |
| 3,691,910 | 9/1972 | Reichel et al. . | |
| 4,037,521 | 7/1977 | McLeod | 91/499 |
| 4,117,768 | 10/1978 | Affouard | 91/499 |
| 4,464,979 | 8/1984 | Forster . | |
| 4,579,043 | 4/1986 | Nikolaus et al. . | |
| 4,602,554 | 7/1986 | Wagenseil et al. . | |
| 4,615,257 | 10/1986 | Valentin . | |
| 4,642,032 | 2/1987 | McBeth . | |
| 4,860,641 | 8/1989 | Spears . | |
| 5,086,689 | 2/1992 | Masuda . | |
| 5,236,312 | 8/1993 | Finn et al. . | |
| 5,320,498 | 6/1994 | Fuchida . | |

FOREIGN PATENT DOCUMENTS

| | | | |
|---|---|---|---|
| 408147 | 1/1925 | Germany | 91/505 |
| 441952 | 3/1927 | Germany | 91/505 |
| 444458 | 5/1927 | Germany | 91/499 |
| 529589 | 7/1931 | Germany | 92/71 |
| 1 403 765 | 1/1969 | Germany . | |
| 43-18287 | 5/1968 | Japan | 91/499 |
| 1631196 | 12/1988 | U.S.S.R. . | |
| 267265 | 3/1927 | United Kingdom | 91/505 |

*Primary Examiner*—Hoang Nguyen
*Attorney, Agent, or Firm*—Jansson & Shupe, Ltd.

[57] ABSTRACT

The disclosure relates to a pump having (a) a wobble plate, (b) a barrel, (c) a pair of piston assemblies reciprocated in the barrel by the wobble plate, and (c) a mechanism retaining the piston assemblies in contact with the wobble plate. In the improvement, the mechanism comprises a yoke member contacting the piston assemblies and a support member mounted to the barrel. The support member has a concave surface and the yoke member has a convex surface contacting the concave surface for bearing support. The support member coacts with the yoke member and permits oscillation of such yoke member in a plane substantially coincident with the barrel central axis. The new hold-down mechanism may be "cascaded" in that the pump may also include another pair of piston assemblies and a second yoke member contacting the second pair of piston assemblies. A bearing component, e.g., a spherical ball, is interposed between the yoke members.

12 Claims, 14 Drawing Sheets

HOLD-DOWN MECHANISM FOR HYDRAULIC PUMP

RELATED APPLICATION

This application is a continuation-in-part of copending application Ser. No. 08/317,213 filed on Oct. 3, 1994, now U.S. Pat. No. 5,490,444 issued Feb. 13, 1996.

FIELD OF THE INVENTION

This invention relates generally to pumps and, more particularly, to pumps having plural pumping pistons reciprocated by a wobble plate.

BACKGROUND OF THE INVENTION

The preponderance of hydraulic pumps made today fall into one of three broad design types, namely, gear, vane and piston. Piston pumps are further broken down into two design types, namely, valve plate and check ball pumps. As examples, the pumps depicted in U.S. Pat. Nos. 4,579,043 (Nikolaus et al.) and 4,602,554 (Wagenseil et al.) are of the valve plate type while that depicted in U.S. Pat. No. 3,514,223 (Hare) is a check ball pump. Some features of valve plate and check ball pumps will now be described.

Valve plate pumps include a cylinder barrel having a number of pistons reciprocating in it. Such barrel is coupled to the pump shaft and rotates with the shaft and as a consequence, the pistons in a valve plate pump both rotate with the pump barrel and reciprocate in such barrel.

Such pistons are caused to reciprocate by rotating the barrel with respect to a stationary "swash plate" or wobble plate. Barrel rotation urges pistons toward a fluid-porting cover as the piston shoe moves along the "rising" part of the wobble plate. Fluid, e.g., hydraulic oil, between the distal end of the piston and the cover is expelled through the cover and into a tube or hose to perform useful work. As the pistons move along the "alling" part of the wobble plate, they move away from the cover and draw fluid into the enlarging cavity between the cover and the piston distal end.

At their proximal ends, the pistons typically have a flat-faced shoe that rides along the angled face of the wobble plate. During pump operation, it is important to maintain the shoe in contact with such face—shoe "liftoff" can result in a damaged shoe and, in a more aggravated case, in a pump that destroys itself.

In a valve plate piston pump, there are a number of ways to hold the piston shoes in contact with the wobble plate. One way is to use an annular plate having a number of holes formed therein equal to the number of pistons. Such plate, shown in the Wagenseil et al. patent, for example, and identified therein as a "contact pressure plate," closely resembles the dial plate of a rotary-dial-type telephone. Other ways to hold a piston in contact with an undulating surface in a valve plate pump is by an internal spring (U.S. Pat. No. 5,320,498 (Fuchida) or by a "head-grasping" arrangement as shown in U.S. Pat. No. 4,860,641 (Spears).

In a typical check ball pump like that shown in the Hare patent, the barrel having the reciprocating pistons does not rotate. On the other hand, the wobble plate (or a thrust plate analogous to the wobble plate) rotates when driven by the pump shaft. The interior of the pump housing is flooded with oil and as each piston moves away from the front cover, the cavity between the piston distal end and the pump cover fills with oil. Filling is through one or more piston "fill holes" in fluid communication with the flooded housing interior and the piston cavity and oil which flows through such holes then flows across an inlet check valve inside the piston. This part of piston travel is often referred to as the "suction stroke."

As the wobble plate continues rotation and a piston moves toward the front cover, its discharge check valve (mounted in the pump cover) opens and the volume of oil in the aforedescribed cavity is expelled through the cover and into a tube or hose to perform useful work. This part of piston travel is often referred to as the "discharge stroke" or "pressure stroke."

While check valve pumps have been available for decades and have proven sturdy and reliable even in harsh operating environments, it has become apparent that steps needed to be taken to obtain greater displacement from a given frame size. However, certain structural features, seemingly inherent in pumps of this type, militate against significant increases in such displacement.

Such features relate to the need to hold the shoe of each reciprocating piston in intimate contact with the rotating wobble plate. A common technique, depicted in the Hare patent noted above, involves a spring retainer plate attached at a reduced-diameter "neck" between the spherical piston head and the cylindrical body. A trepan groove is formed in the pump barrel concentric with each piston bore and a compression-type piston return spring is mounted in the groove. When the piston is inserted in the barrel, the spring bears against the retainer plate and urges the piston toward the wobble plate.

A fact of this arrangement is that for a given housing cavity size (and pump size and "mass"), the spring and retainer plate occupy a significant part of the cavity volume. Another fact is that as the springs and retainer plates move through the oil contained in the cavity, there is necessarily some loss in efficiency. Simply put, the oil resists movement of the plate and spring.

Yet another aspect of the above-noted check valve pump design is that the piston fill holes are required to be relatively small. As a consequence, inlet supercharge is indicated for many installations since the pistons would not other-wise fill properly. Users often resist having to provide such supercharge and the maximum speed of the pump is somewhat limited. Yet another fact is that if supercharge is increased beyond a few pounds per square inch, one has to consider the use of high pressure shaft seals.

The known arrangement (as typified by the pump of the Hare patent) involves a relatively large number of parts. Further, many of such parts were required to be machined in a way that, in view of the invention, is unnecessary. For example, the pistons of the pump shown in the Hare patent have "necked-down" portions machined therein adjacent to the piston shoe. A snap ring groove is machined in such necked-down portion to receive a snap ring for holding the shoe on the end of the piston. And because of the relatively large number of parts, the time required to assemble a pump of the type shown in such patent is rather significant.

An improved piston pump which overcomes some of the problems and shortcomings of known pumps would be an important advance in the art.

OBJECTS OF THE INVENTION

It is an object of the invention to provide a pump having an improved piston hold-down mechanism overcoming some of the problems and shortcomings of the prior art.

Another object of the invention is to provide a pump having an improved piston hold-down mechanism involving a simplified piston construction.

Another object of the invention is to provide a pump having an improved piston hold-down mechanism including a simplified piston shoe.

Yet another object of the invention is to provide a pump having an improved piston hold-down mechanism which is highly effective in retaining piston shoes in contact with a wobble plate.

Another object of the invention is to provide a pump having an improved piston hold-down mechanism permitting substantially increased pump displacement for a given pump "frame" size.

Still another object of the invention is to provide a pump having an improved piston hold-down mechanism facilitating improved piston filling characteristics.

Yet another object of the invention is to provide a pump which reduces or eliminates the need for inlet supercharge, at least up to higher operating speeds than heretofore possible.

Another object of the invention is to provide a pump having an improved piston hold-down mechanism having a reduced number of parts.

Yet another object of the invention is to provide a pump having an improved piston hold-down mechanism which substantially avoids "wear points" at the piston fill opening. How these and other objects are accomplished will become apparent from the following descriptions and from the drawing.

SUMMARY OF THE INVENTION

The invention involves a pump of the type having (a) a wobble plate, (b) a barrel, (c) a first pair of piston assemblies reciprocated in the barrel by the wobble plate, and (c) a piston hold-down mechanism retaining the piston assemblies in contact with the wobble plate. The piston assemblies reciprocate in bores located on a bore circle and the piston assemblies are coincident with a diameter of the bore circle.

In the improvement, the hold-down mechanism comprises a bar-like, one-piece yoke member contacting the piston assemblies. A rod-like support member is mounted with respect to the barrel, e.g., in an axial passage in the barrel, and supports and coacts with the yoke member. (In the portion of this summary which describes a four-piston pump, such yoke member is sometimes referred to as a "first" yoke member.)

The yoke member is permitted to oscillate in a plane substantially coincident with the barrel central axis. That is to say, such yoke member does not undulate. More specifically, the support member has a groove with a concave surface. The yoke member is received in the groove and has a convex surface contacting and riding on the concave surface.

Each piston assembly includes at least one fill opening through which fluid, e.g., hydraulic oil, enters the piston. The yoke member has a pair of laterally-extending arms and in one embodiment, each arm contacts a separate piston assembly at the fill opening. In another, slightly-different (and more preferred) embodiment, the yoke member extends into each fill opening and contacts a hold-down ball in the piston assembly.

As its name suggests, the new hold-down mechanism is effective in holding the piston shoes in contact with the driving wobble plate. Each piston assembly includes a piston having a spheroid head and a piston shoe contacting the wobble plate and having a spheroid cavity receiving the head. The yoke member retains the shoe between the head and the wobble plate.

The preceding part of this summary describes a pump having two piston assemblies. But the new hold-down mechanism may be cascaded and is not limited to use with pumps of that type. Such mechanism may also be used with pumps having four, six or even eight piston assemblies. For example, where the pump includes a second pair of piston assemblies reciprocated in the barrel by the wobble plate, the mechanism further comprises a second yoke member contacting the second pair of piston assemblies.

A bearing component such as a spherical steel ball is interposed between the yoke members. Each yoke member includes a pocket and the bearing component is received in the pockets and retained in position by such pockets. In the hold-down mechanism used with a four-piston pump, the yoke members are inverted with respect to one another.

Further details regarding the new hold-down mechanism are set forth in the drawings and in the detailed description.

DETAILED DESCRIPTION OF THE PREFERRED EMBODIMENTS

Figure 1:
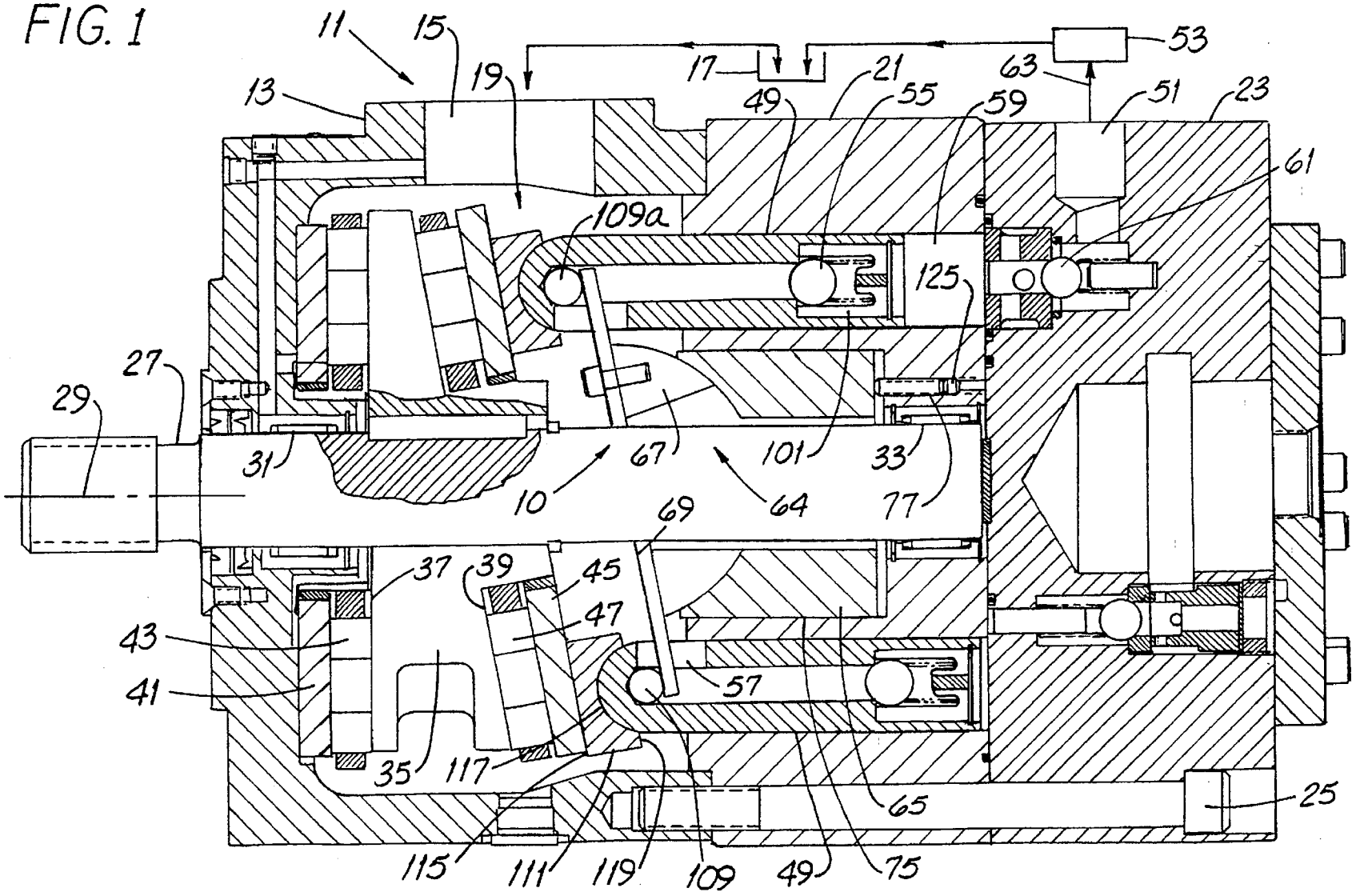
FIG. 1 is a cross-sectional side elevation view of a check valve piston pump incorporating the inventive hold-down mechanism. Parts are broken away and cross-hatching is omitted on certain other parts.

Before describing the many new features of the inventive hold-down mechanism 10, a general description of the construction and operation of one type of check ball pump 11 will be provided. The pump 11 is assumed to be used with some type of liquid pressure medium, e.g., ethylene glycol, hydraulic oil or the like. (In this specification, terms such as "left," "right" and the like are with respect to the drawing, are used for ease of explanation and are not limiting.)

Referring to FIG. 1, the pump 11 has a housing 13 with an inlet opening 15 leading from a reservoir 17 of fluid to an interior cavity 19. A barrel 21 and cover 23 are attached to the housing 13 by bolts 25. The pump drive shaft 27 extends through the housing 13 and is supported for rotation about the axis 29 by spaced sets 31 and 33 of needle bearings mounted in the housing 13 and in the barrel 21, respectively. The shaft 27 is coupled to and driven by a prime mover such as an internal combustion engine or an electric motor, not shown.

The shaft 27 is keyed or otherwise attached to a circular, wedge-shaped wobble plate 35 having a planar left face 37 generally normal to the axis 29 and a planar right face 39 angled with respect to such axis 29. The pump 11 also has an annular, flat left thrust plate 41 and a "pancake-type" thrust bearing 43 interposed between the face 37 and the thrust plate 41. Similarly, there is a right thrust plate 45 and a thrust bearing 47 interposed between such thrust plate 45 and the right face 39 of the wobble plate 35.

Neither the thrust plates 41, 45 nor the thrust bearings 43, 47 are attached to the shaft 27 or to the wobble plate 35 in a way to cause such plates 41, 45 or bearings 43, 47 to rotate at shaft speed. However, "viscous drag," more prevalent with hydraulic oil than with thinner liquid such as ethylene glycol, tends to cause such plates 41, 45 and bearings 43, 47 to rotate about the axis 29 at a relatively modest rate. The aforedescribed arrangement of housing 13, barrel 21, shaft 27, wobble plate 35, thrust plates 41, 45 and thrust bearings 43, 47 is known.

The manner in which a particular piston assembly 49 delivers fluid to a pressurized outlet port 51 and thence to a hydraulic "work-performing" circuit 53 will now be described. As the wobble plate 35 rotates, each assembly, e.g., assembly 49, moves leftward and its inlet check valve 55 unseats. Liquid is thereby permitted to flow from the housing cavity 19 through one or more piston fill holes 57 and into the piston interior. Such liquid fills the cavity 59 between the piston distal or right end and an outlet check valve 61 in the cover 23 and it is to be appreciated that during such leftward movement of the assembly 49, the volume of such cavity 59 is increasing.

As the piston assembly 49 starts to move rightward, the inlet check valve 55 closes, the pressure in the cavity 59 rises rapidly and the outlet check valve 61 opens when such pressure slightly exceeds the pressure in the outlet circuit 63. The volume of the cavity 59 diminishes and fluid in the cavity 59 is thereby delivered to such circuit 63. From the foregoing, it will be appreciated that each piston assembly 49 makes one leftward "suction" excursion and one rightward "pressure" excursion for each revolution of the wobble plate 35.

Often, the fluid expelled from the several piston cavities 59 is directed to a common circuit 63 connected to the outlet port 51. However, "Split-Flow"® configurations are possible wherein groups of piston assemblies 49, each comprising less than all of the assemblies 49 in the pump 11, power separate outlet ports 51.

Details of an embodiment of the new hold-down mechanism 10 will now be described. That will be followed by an explanation of how such mechanism 10 operates. Referring also to FIGS. 2, 3, 4, 5 and 6 the new mechanism 10 has a pivot device 64 including a hold-down sleeve 65, a spherical guide member 67 and a hold-down plate 69. Each is described in turn.

The hold-down sleeve 65 is tubular, generally cylindrical and has a spherical pocket 71 formed in one end. The pump shaft 27 extends through the central opening 73 and the sleeve 65 is retained in a cylindrical cavity 75 formed in the barrel 21. The barrel 21 also includes an adjustable mechanical stop 77, the function of which is described below.

The spherical guide member 67 has a central opening 79 for receiving the shaft 27 therethrough. The "bearing" surface 81 of the guide member 67 is spherical and conforms to the shape of the pocket 71 in the sleeve 65 so that the guide member 67 and sleeve 65 form what may be termed a "ball-and-socket" joint. That surface 83 opposite the bearing surface 81 is generally flat and has holes 85 for receiving fasteners attaching the hold-down plate 69 to the member 67.

Figure 5:
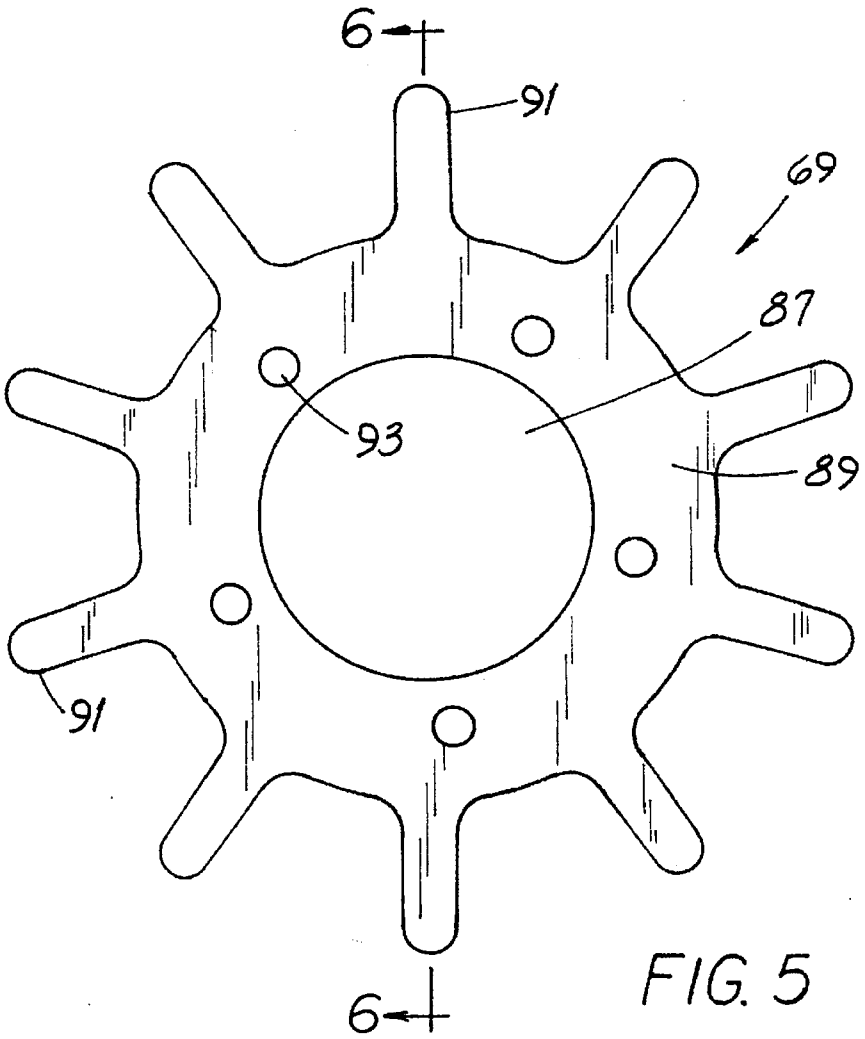
FIG. 5 is an end view of the hold-down plate used in the pump of FIG. 1.
Figure 6:
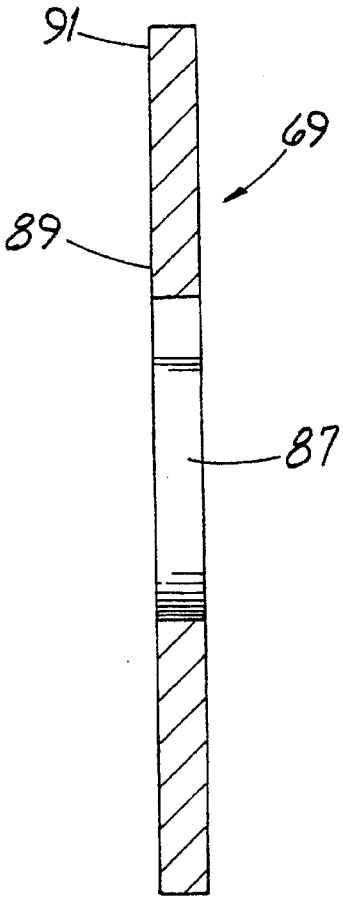
FIG. 6 is a cross-sectional view of the hold-down plate of FIG. 5 taken along the viewing plane 6—6 thereof.

Referring particularly to FIGS. 1, 5 and 6, the disc-like hold-down plate 69 is generally flat, has a central aperture 87, an annular body 89 and a plurality of retention or hold-down fingers 91 projecting radially outward from such body 89. In a highly preferred arrangement, the number of fingers 91 and the number of piston assemblies 49 in the pump 11 are equal to one another. The plate 69 also includes a number of holes 93 used to attach the plate 69 to the guide member 67 as described above.

Figure 7:
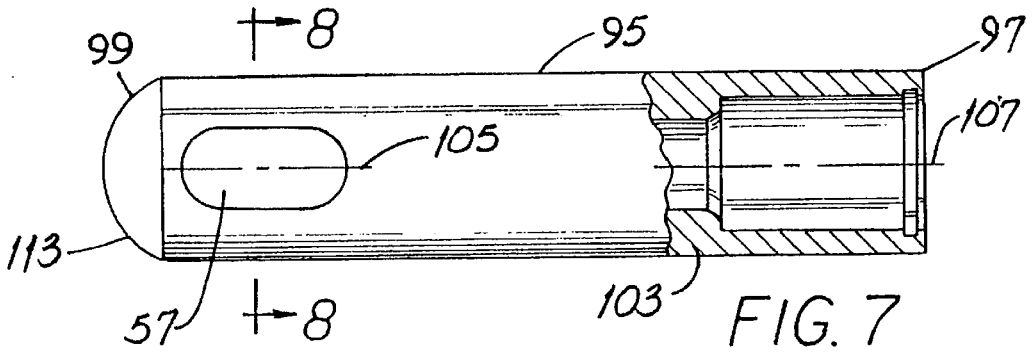
FIG. 7 is a side view of a piston used in the pump of FIG. 1. Parts are broken away and shown in cross-section.
Figure 8:
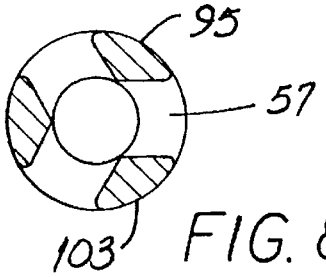
FIG. 8 is a cross-section view of the piston of FIG. 7 taken along the viewing plane 8—8 thereof.

Referring particularly to FIGS. 1, 7 and 8, a piston assembly 49 will now be described. Such assembly 49 includes a hollow, generally cylindrical piston 95 having a "squared-off" distal end 97 and a spherical proximal end 99. An inlet check valve 55 and ball-retaining cage 101 are secured in the end 97. There are one or more piston fill holes 57 through the piston wall 103 and such holes 57 permit liquid from the housing cavity 19 to flow into and through the piston 95 as each piston assembly 49 is reciprocated as described above.

In a highly preferred embodiment, there are three elongate holes 57 in the wall 103 and such holes 57 are spaced about 120° apart around the piston circumference. The long axes 105 of such holes are generally parallel to the long axis 107 of the piston 95 and to the pump axis of rotation 29. While a specific fill hole configuration has been described, it should be appreciated that the number and configuration of such fill holes 57 may vary without departing from the spirit of the invention.

Figure 9:
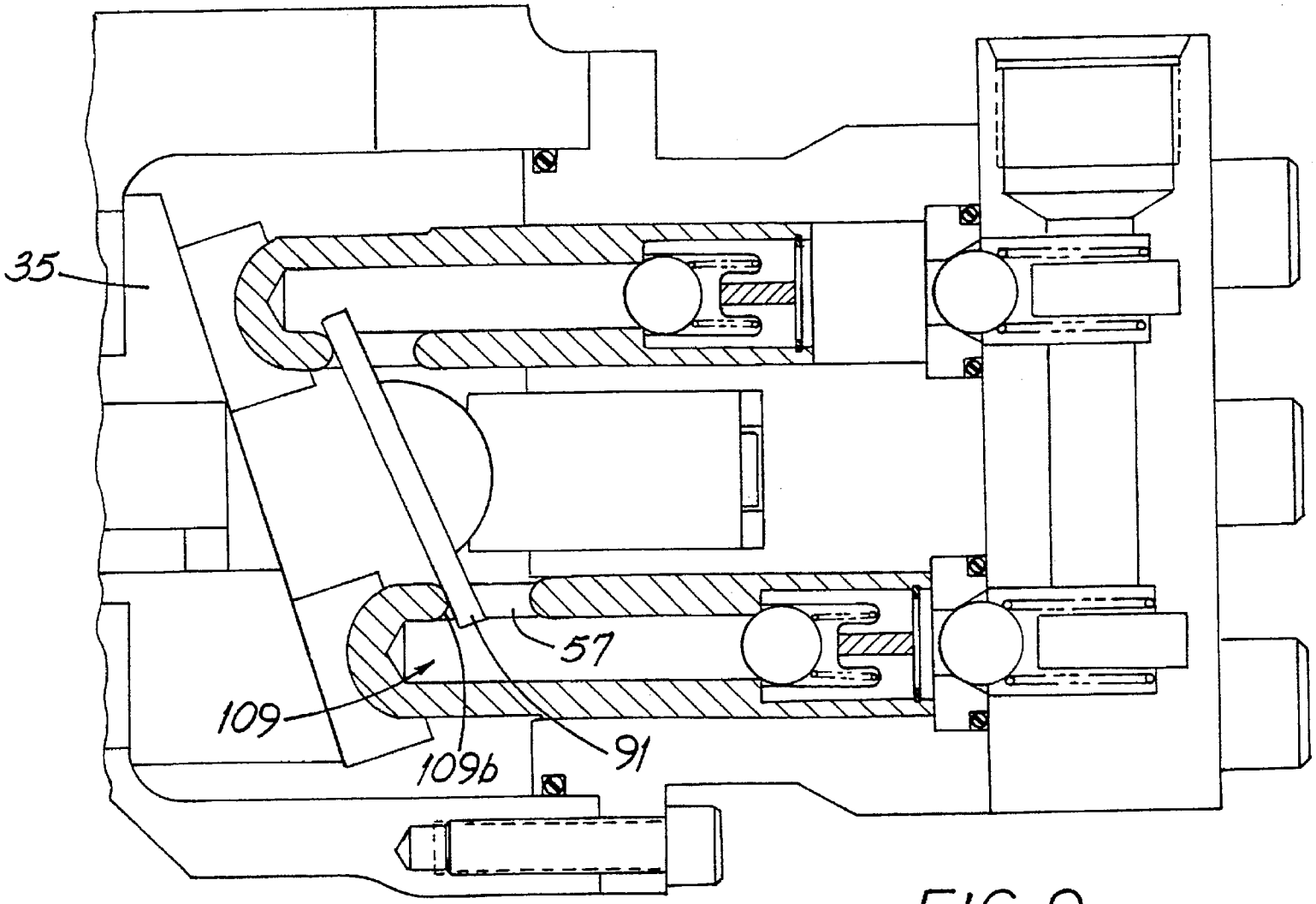
FIG. 9 is a side elevation view of another embodiment of the inventive hold-down mechanism shown in conjunction with another type of check valve pump.

Each piston assembly 49 also includes a finger-contact portion 109 against which a hold-down finger 91 bears to retain the piston shoe 111 in contact with the plate 45. In the embodiment shown in FIG. 1, the portion 109 comprises a ball **109*a* in the piston interior at the piston proximal end 113. (During assembly, such ball 109*a* is held in place by a small quantity of grease and thereafter is "captured" between a finger 91 and the proximal end 113.) In another embodiment shown in FIG. 9, the finger-contact portion 109 comprises a rounded edge 109*b* of the piston wall 103 (and, specifically, a rounded end of a fill hole 57) against which the hold-down finger 91** bears.

Referring again to FIG. 1, the piston assembly 49 includes a shoe 111 interposed between the plate 45 and the proximal end 113 of the piston 95. Such shoe 111 is generally cylindrical, has a flat bearing surface 115 and a spherical surface 117 the latter conforming to the shape of the spherical proximal end 113.

Figure 10:
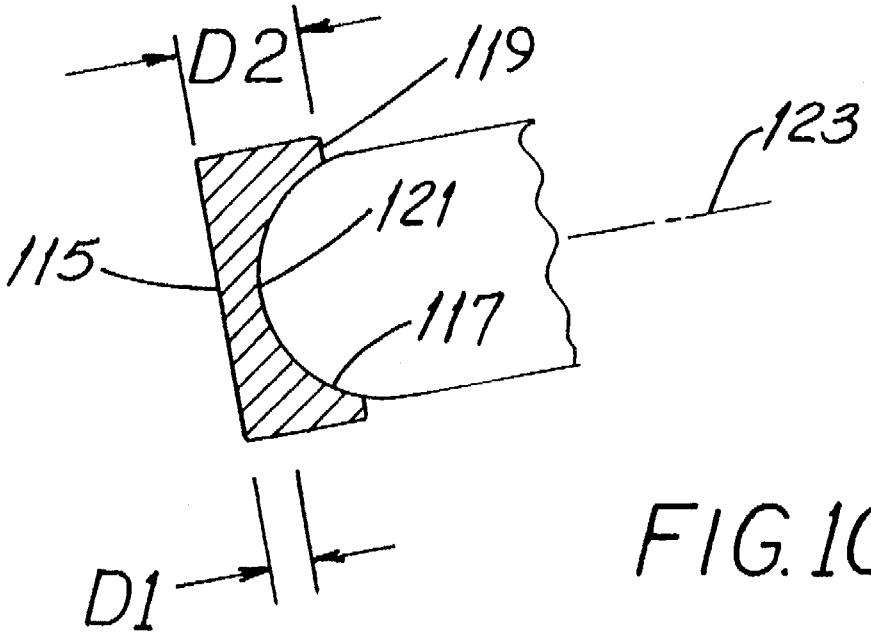
FIG. 10 is a side elevation view of a piston shoe in cross-section and the piston associated with such shoe. Parts are broken away.

Referring also to FIG. 10, an annular shoulder 119 circumscribes the spherical surface 117 and it is to be noted that the dimension "D1" from the center 121 of the surface 117 to the surface 115 is less than the dimension "D2" from the shoulder 119 to such surface 115. When the piston 95 and shoe 111 are cooperatively configured in that way, the shoe 111 is retained between the piston 95 and the plate 45 solely by being "captured" therebetween. To put it another way, there is no need for complex shoe and piston configurations involving use of a shoe-attaching snap ring as shown in the above-noted Hare patent.

The pump parts are assembled as shown in FIG. 1. A separate hold-down finger 91 extends into a fill hole 57 of each piston 95 and bears against the piston finger-contact portion 109, whether ball **109*a*, or piston wall 109*b*. The threaded mechanical stop 77 is adjusted so that the guide member 67 undulates freely in the pocket 71 of the sleeve 65 and so that the piston shoes 111 can undulate freely about an axis 123 perpendicular to the shoe surface 115. In other words, adjustment should be such that there is no "binding" of such parts. The lock screw 125 is then tightened against the stop 77 and the shoes 111 are retained in a "fixed clearance" relationship with respect to the plate 45. In this "positive hold-down" arrangement, the shoes 111 are not urged against the plate 45; rather, they are prevented from moving away from such plate 45**.

In operation, the pump shaft 27 and wobble plate 35 are rotated and the piston assemblies 49 are thereby caused to reciprocate, each pumping liquid into the circuit 63. During such operation, the hold-down plate 69 and guide member 67 exhibit what may be described as undulating movement. Since the hold-down plate 69 is always spaced from and parallel to the wobble plate face 39, the piston assemblies 49 (and, specifically, the piston shoes 111) are continuously "held down" against the plate 45.

Figure 12:
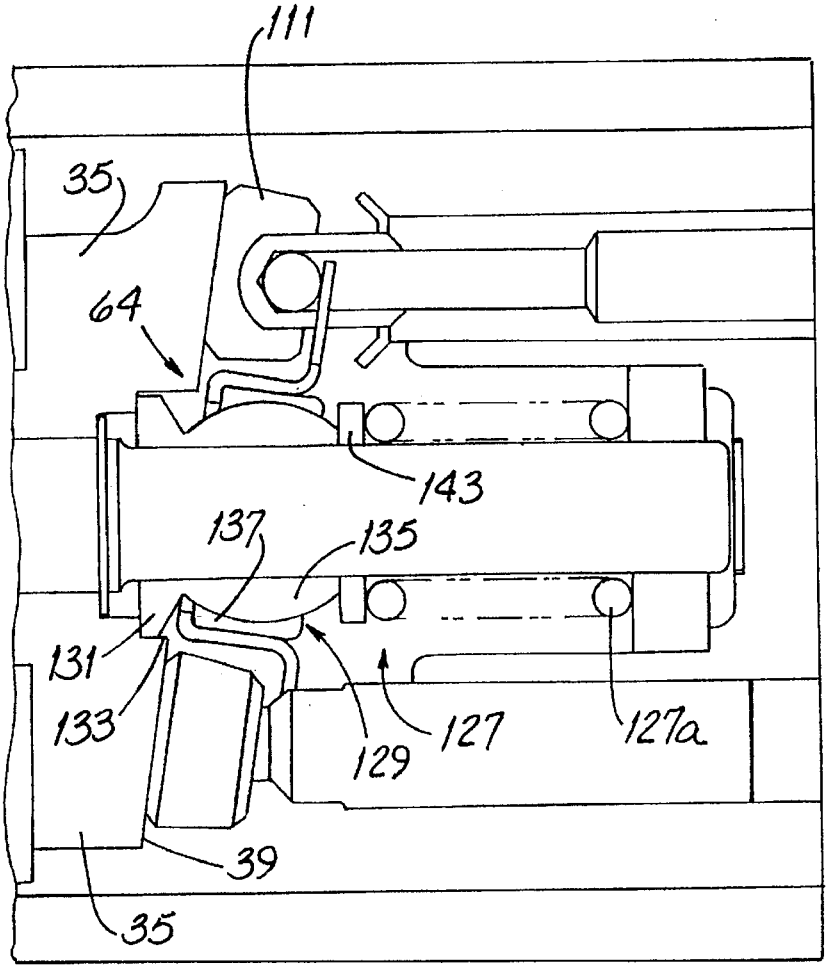
FIG. 12 is a cross-sectional side elevation view of still another type of check valve piston pump incorporating yet another embodiment of the new hold-down mechanism. Parts are broken away.
Figure 11:
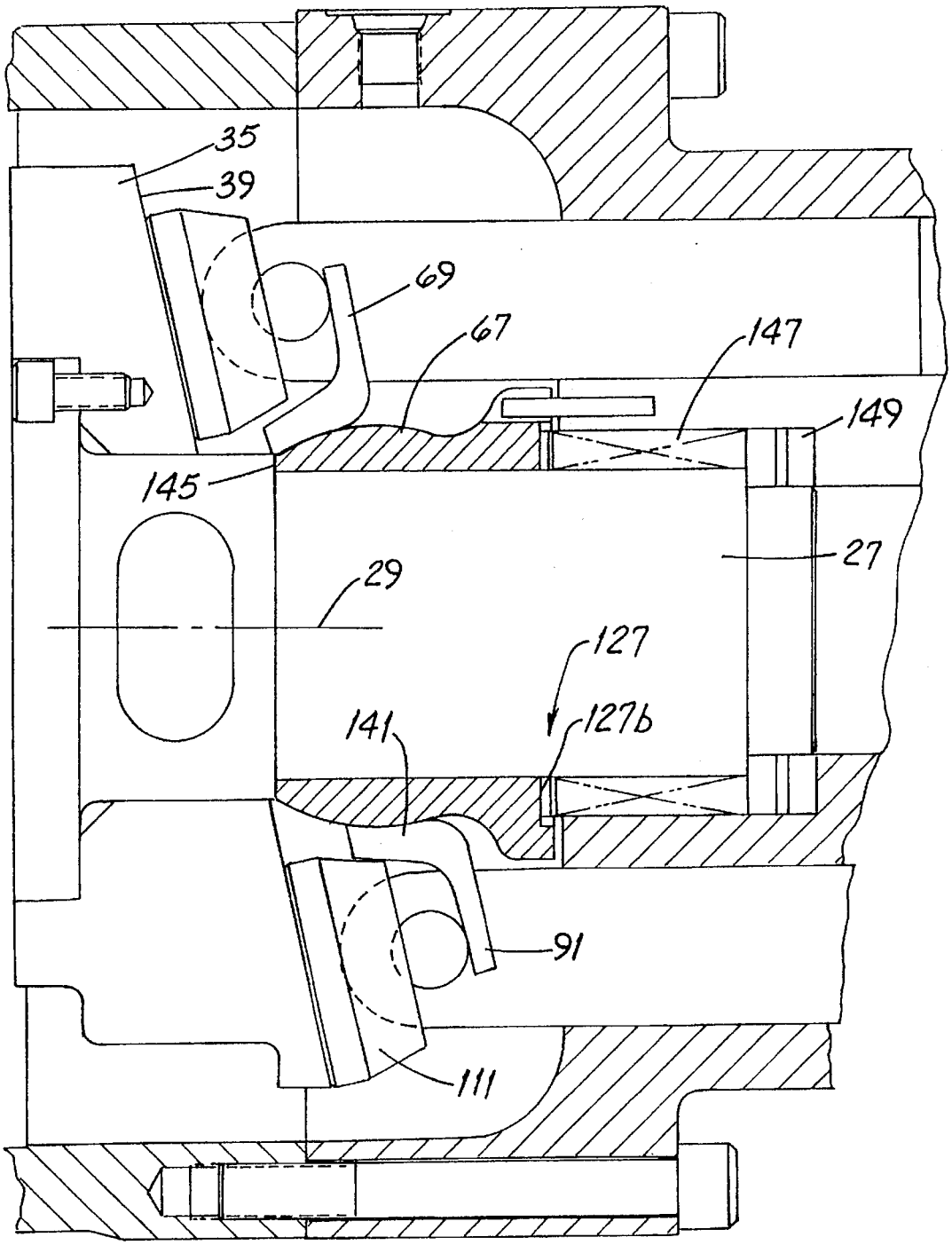
FIG. 11 is a cross-sectional side elevation view of yet another type of check valve piston pump incorporating another embodiment of the new hold-down mechanism. Parts are broken away and cross-hatching is omitted on certain other parts.
Figure 15:
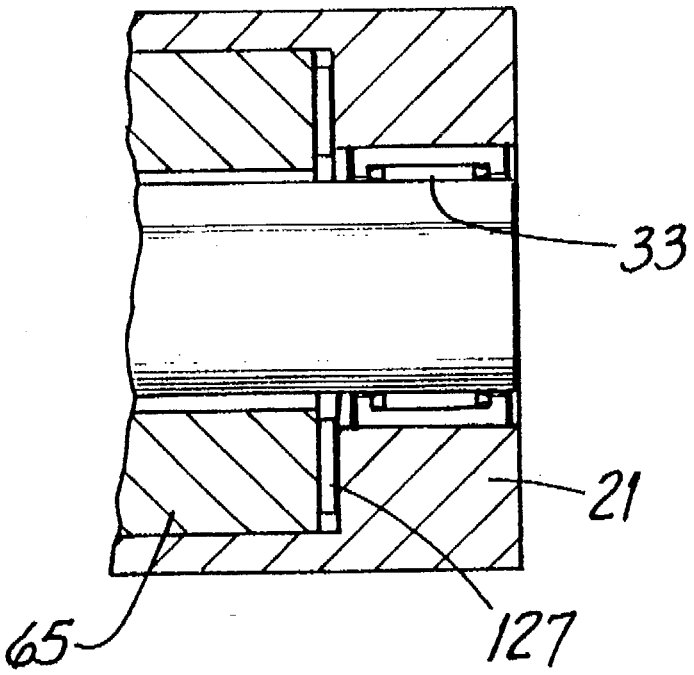
FIG. 15 is a cross-sectional side elevation view of a portion of the pump of FIG. 1 and shows a compression member in place of the mechanical stop shown in FIG. 1.

Referring now to FIGS. 11, 12 and 15, a compression member 127 may be used in place of the mechanical stop 77. Such compression member 127 may comprise a coil spring **127*a* or a high-rate spring like a wave spring 127*b*. (Wave springs are annular and have radially-oriented crests and valleys. A source of wave springs is Smalley Steel Ring Co. of Wheeling, Ill.) In this configuration, the piston shoes 111 are urged against the wobble plate surface 39 by the compression member 127 but may move away from such surface 39 at least slightly if the force of the compression member 127** is overcome.

Figure 14:
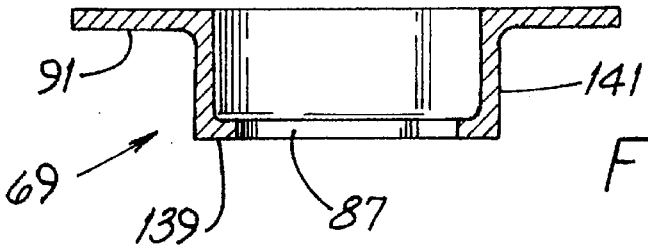
FIG. 14 is a cross-sectional view of the hold-down plate of FIG. 13 taken along the viewing plane 14—14 thereof.
Figure 13:
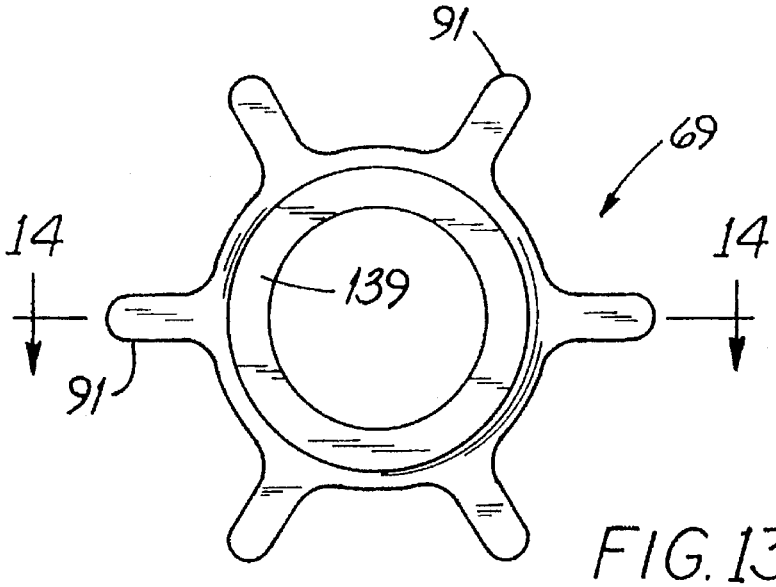
FIG. 13 is an end view of the hold-down plate used with the pump of FIG. 12.
Figure 2:
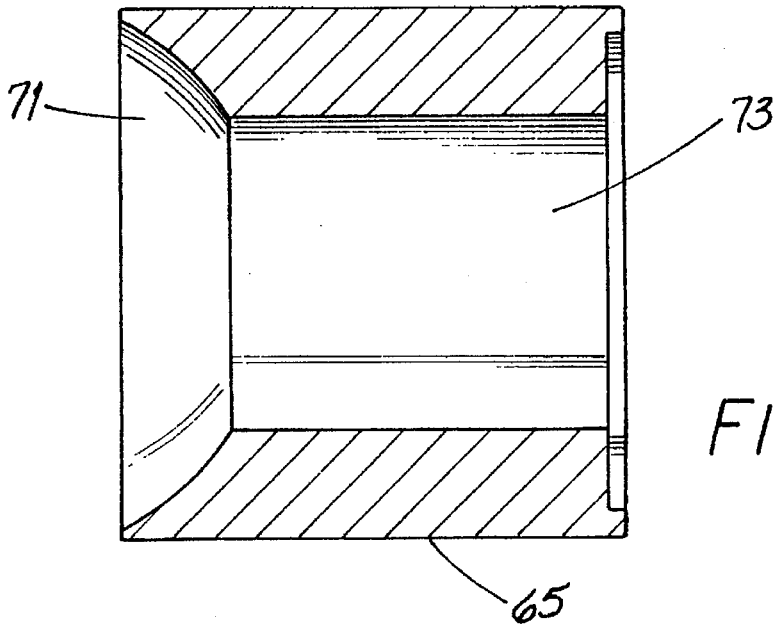
FIG. 2 is a cross-sectional side elevation view of the hold-down sleeve used in the pump of FIG. 1.
Figure 4:
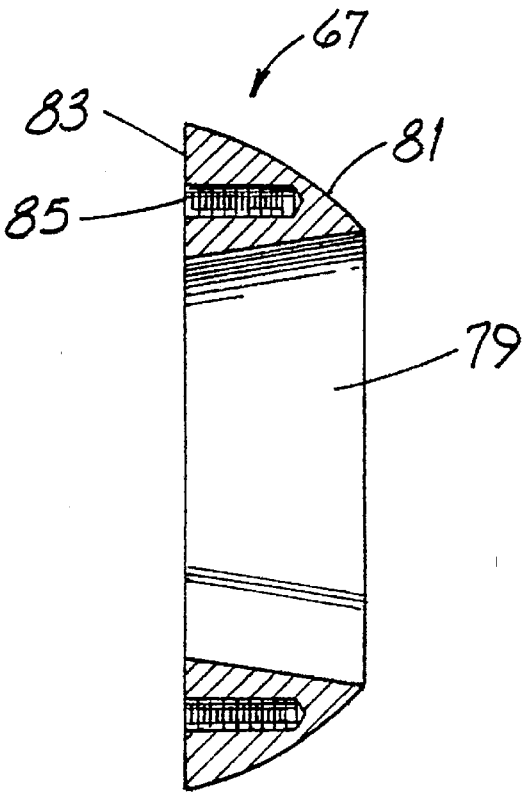
FIG. 4 is a cross-sectional view of the guide member of FIG. 3 taken along the viewing plane 4—4 thereof.
Figure 3:
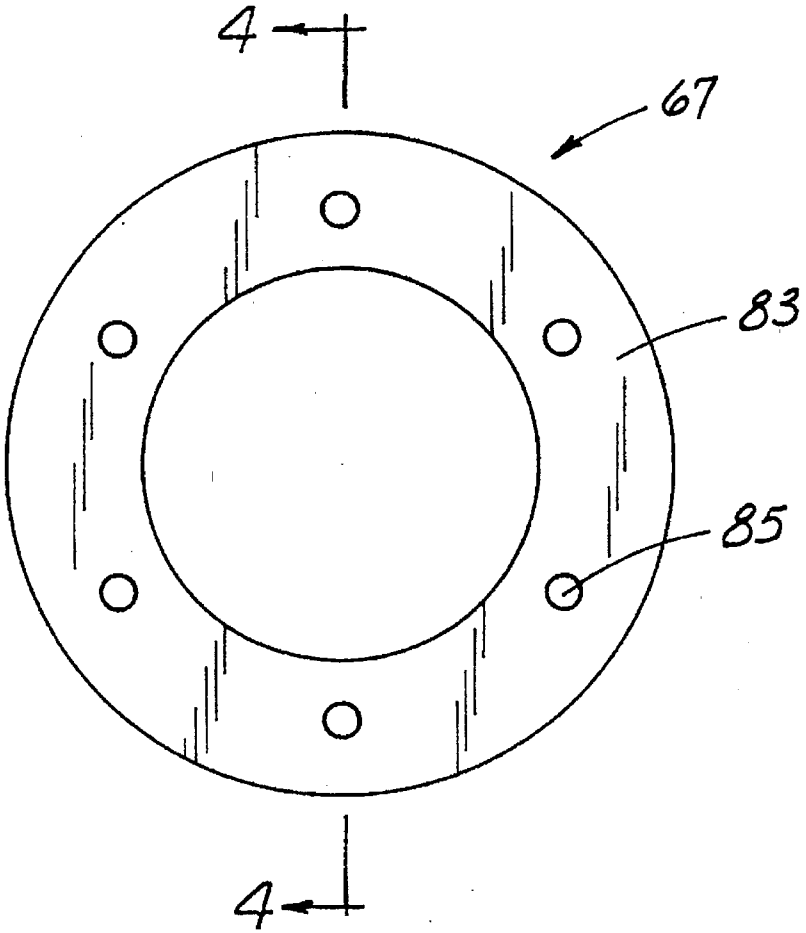
FIG. 3 is an end view of the guide member used in the pump of FIG. 1.

Referring next to FIGS. 12, 13, and 14, another embodiment of the new hold-down mechanism 10 will now be described. In the arrangement of FIGS. 12, 13 and 14 (which involves a six-piston pump 11), the pivot device 64 is a bearing 129 having a base 131 received in a socket 133, a spheroid member 135 and an annular, ring-like outer race 137 mounted on the spheroid member 135 for undulating movement.

In cross-section, the hold-down plate 69 is "hat-shaped" and has an annular retaining lip 139, a cylinder-like annular side wall 141 and retention fingers 91 perpendicular to and extending radially outward from the side wall 141. The lip 139 and side wall 141 engage and are supported by the outer race 137. A compression spring **127*a* backed by a spring washer 143 urges the bearing 129 toward the wobble plate 35 and retains the piston shoes 111 in contact with the wobble plate 35**.

The embodiment of FIG. 11 differs only slightly from those described above and includes a guide member 67 urged against a load-bearing shaft abutment shoulder 145 by a wave spring **127*b*. A hold-down plate 69 rides on the guide member 67 and exhibits undulating motion with respect thereto when the pump 11 is operating. In cross-section, the hold-down plate 69 is generally hat-shaped (like that of FIGS. 13 and 14) but rather than being normal to the fingers 91, the side wall 141 is somewhat angular thereto in a direction toward the shaft axis of rotation 29. The right end of the shaft 27 is positioned by a needle bearing 147 and by a disc-like thrust bearing 149**.

As set forth above, this specification includes a description of the pumps 11 of FIGS. 11 and 12 in which the piston shoes 111 ride on the surface of a wobble plate 35 rotating at shaft speed. As used in this specification, the terms "wobble plate," "wobble plate surface" and the like refer to or relate to that component of the pump 11 upon which the piston shoes 111 ride, irrespective of whether such component is a wobble plate 35 rotating at shaft speed or is a thrust plate 45.

The embodiment of the mechanism 10 shown in FIGS. 16–25 will be better appreciated by having an understanding of a characteristic of the embodiment of FIGS. 1–15, 26. In the hold-down mechanism 10 shown in FIGS. 1–15, the hold-down plate 69 exhibits "wave-like" or undulating movement. Such movement resembles that of a carnival attraction known as the "Octopus" but does not involve an eccentric center mount.

Figure 26:
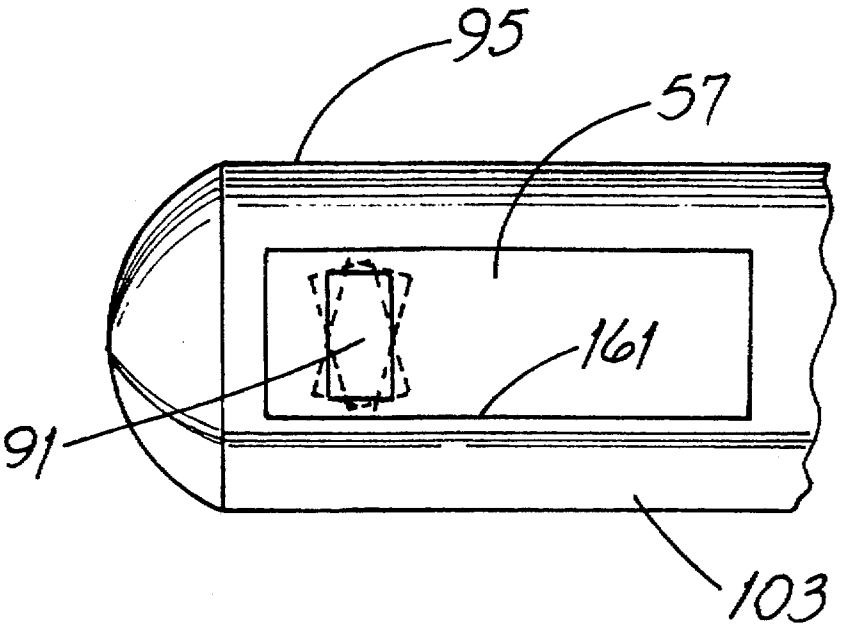
FIG. 26 is a view of a piston and hold-down mechanism arm of the embodiment of FIGS. 1–15 and showing how the arm undulates with respect to the piston.

As a result of such movement, the fingers 91 not only move left-right in the fill hole 57 as shown in FIGS. 7 and 26, they also undulate or tip. When the low point or the high point of the rotating wobble plate 35 is in registry with a particular finger 91, such finger 91 is oriented with respect to the fill hole 57 as shown in solid outline in FIG. 26. But at other positions of the wobble plate 35, the finger 91 is tipped in the hole 57 as represented in dashed outline. The result is that the finger 91 may contact the edge 161 of the fill hole 57. Wearing of the finger 91 and/or the piston wall 103 can result. However trivial or serious such wear may be, the hold-down mechanism 10*a* described below substantially eliminates it.

Figure 16:
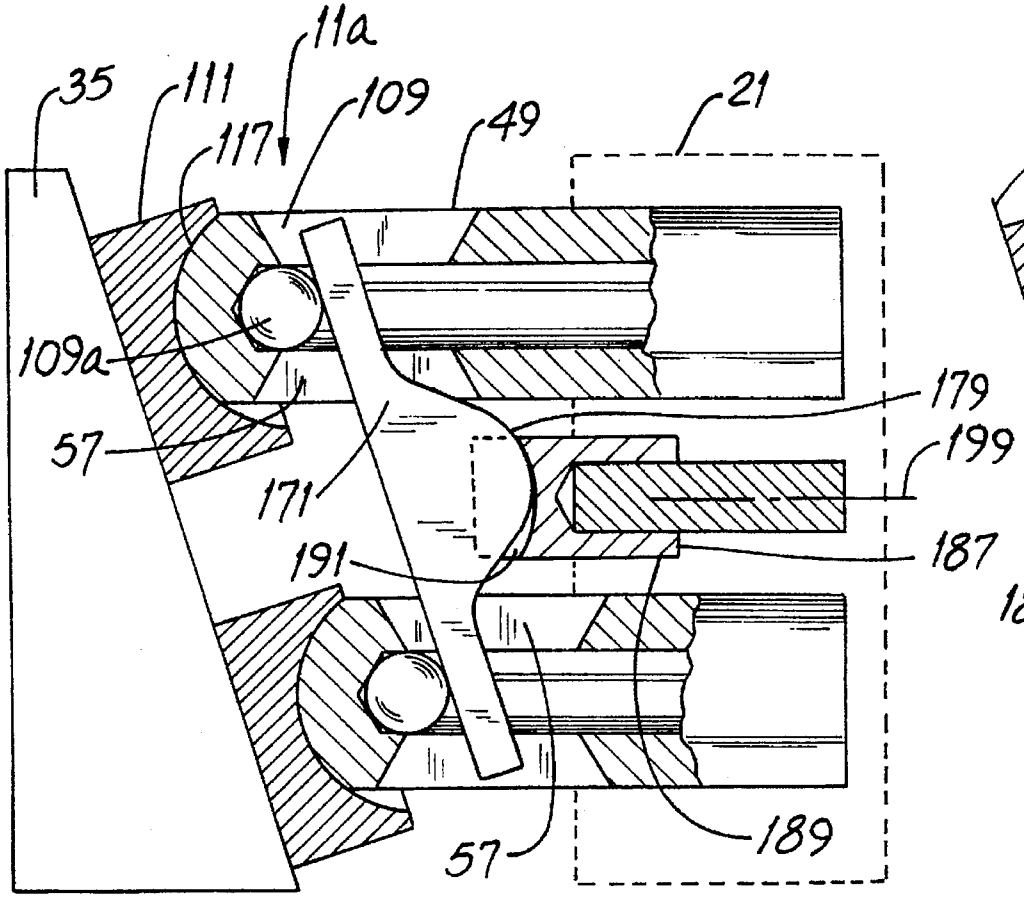
FIG. 16 is a cross-sectional side elevation view of a two-piston check valve pump incorporating a second embodiment of the inventive hold-down mechanism. Parts are broken away, cross-hatching is omitted on certain other parts and yet other parts are shown in dashed outline.
Figure 17:
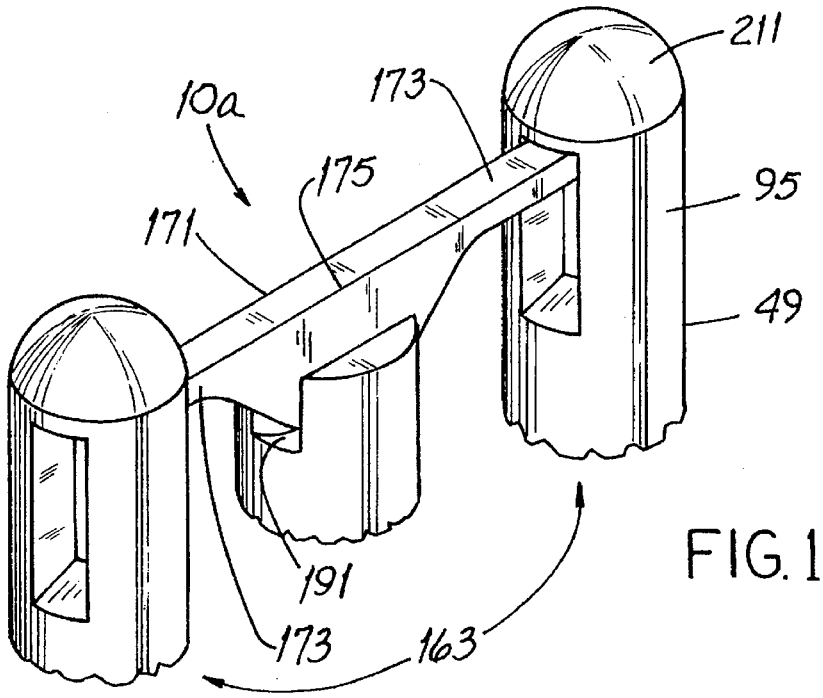
FIG. 17 is a perspective view of a hold-down mechanism shown in conjunction with two piston assemblies. Parts are broken away.
Figure 18:
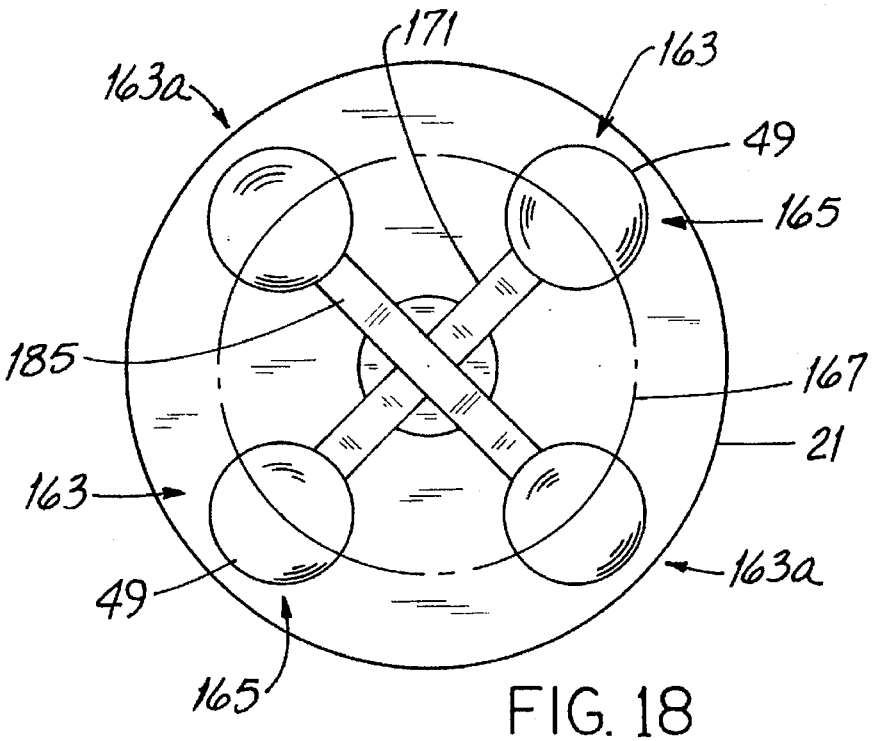
FIG. 18 is a plan view of a hold-down mechanism as used with a four-piston check valve pump. Parts of the pump are omitted for clarity.

Referring now to FIGS. 16, 17 and 18, the pump 11*a* is closely similar in construction and substantially identical in operating principle to the pump 11 shown in FIG. 1. The pump 11*a* has a wobble plate 35, a barrel 21 and a first pair 163 of piston assemblies 49 reciprocated in the barrel 21 by the wobble plate 35. The piston assemblies 49 reciprocate in bores 165 located on a bore circle 167 and the piston assemblies 49 are coincident with a diameter of the bore circle 167.

Figure 19:
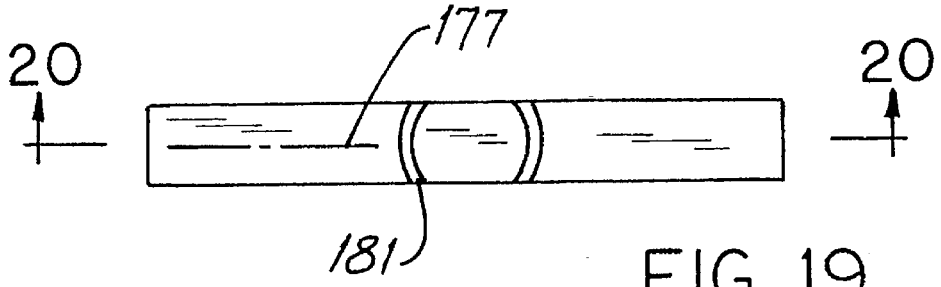
FIG. 19 is a plan view of a component of the new hold-down mechanism, i.e., a yoke member.
Figure 20:
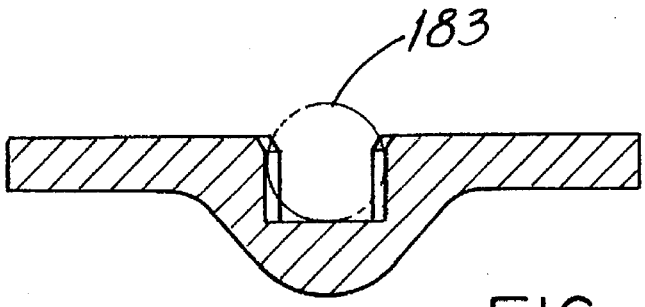
FIG. 20 is a sectional view of the yoke member of FIG. 19 taken along the viewing plane 20—20 thereof.

Referring particularly to FIGS. 16, 19, 20 the hold-down mechanism 10*a* comprises a bar-like, one-piece first yoke member 171 contacting the piston assemblies 49. Such yoke member 171 has a pair of arms 173 extending laterally from a central portion 175. The arms 173 extend along the same axis 177 180° apart, i.e., in opposite directions. The central portion 175 includes a convex bearing surface 179 having a substantially constant radius of curvature. Such portion 175 also has a pocket 181 sized and shaped to receive and retain a bearing component such as a spherical ball bearing.

In an embodiment of the yoke member 171 used only with pumps 11*a* having two piston assemblies 49, the pocket 181 may be omitted from the portion 175 as shown in FIGS. 16 and 17. However, in a highly preferred embodiment, the pocket 181 is included. Pairs of yoke members 171, 185 used in, e.g., pumps 11*a* with four piston assemblies 49 (as described below) are thereby configured to be substantially identical to one another for manufacturing economy.

Figure 21:
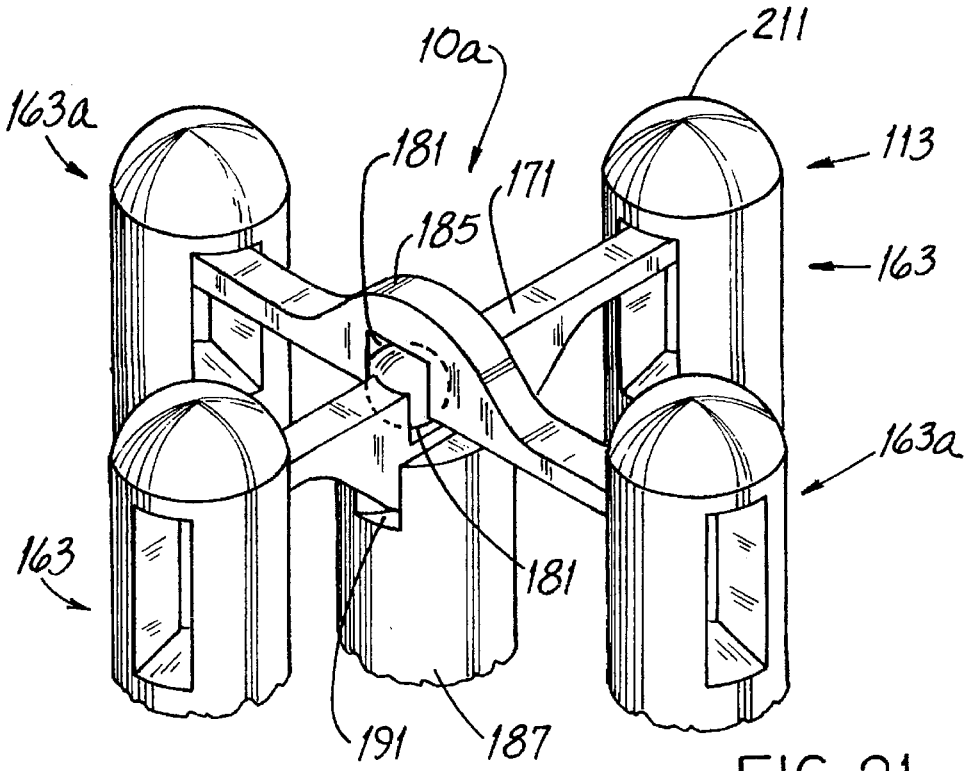
FIG. 21 is a perspective view of a hold-down mechanism shown in conjunction with four piston assemblies. Parts are broken away and a certain part is shown in dashed outline.
Figure 22:
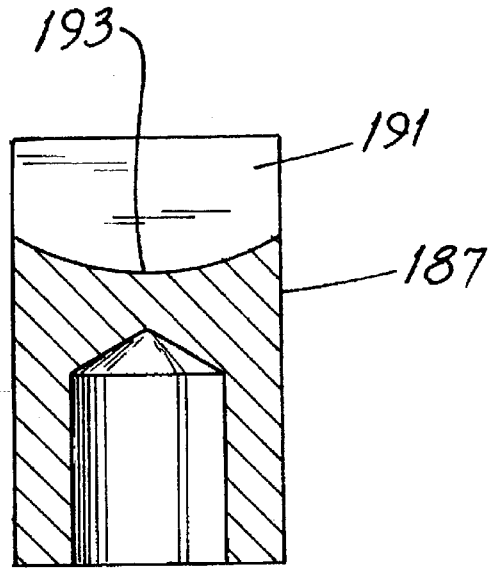
FIG. 22 is a sectional view of a support member used in conjunction with the yoke member of FIGS. 19 and 20.

Referring particularly to FIGS. 21 and 22, a rod-like support member 187 is mounted with respect to the barrel 21, e.g., in an axial passage 189 in the barrel 21, and supports and coacts with the yoke member 171. The support member 187 has a groove 191 with a concave surface 193 having a substantially constant radius of curvature generally equal to the radius of curvature of the yoke member bearing surface 179. The central portion 175 of the yoke member 171 is received in the groove 191 and the convex surface 179 contacts and rides on the concave surface 193.

Figure 23:
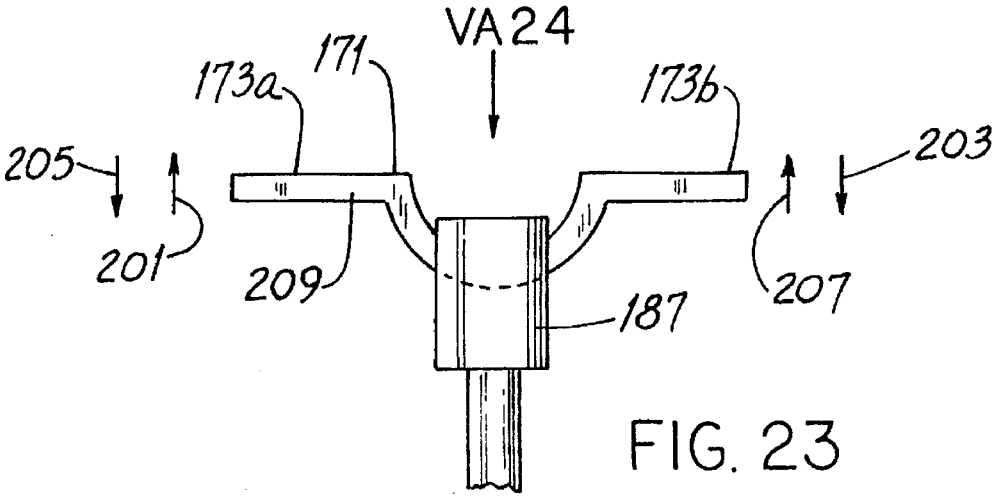
FIG. 23 is an elevation view of a yoke member and support member to illustrate how the yoke member oscillates but is free of nutating motion.
Figure 24:
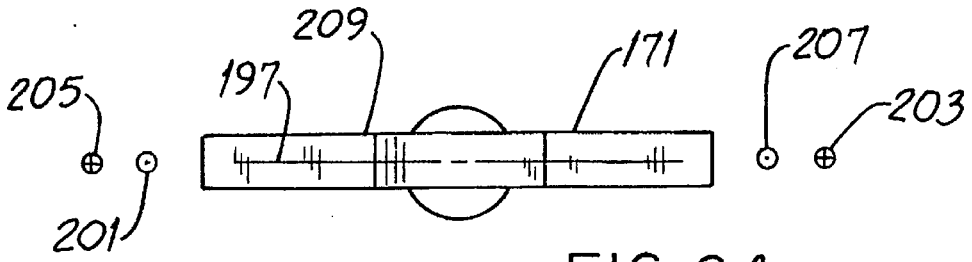
FIG. 24 is a plan view of the yoke member and support member of FIG. 23 taken along the viewing axis VA24 thereof.

Referring particularly to FIGS. 23 and 24, the yoke member 171 does not undulate as does the plate 69 shown in FIGS. 1 and 13. Rather, the member 171 oscillates and such oscillation is in a plane 197 substantially coincident with the barrel central axis 199.

Described another way, the arm 173*a* moves upward as the arm 173*b* moves downward as represented by the arrows 201, 203, respectively. Similarly, the arm 173*a* moves downward as the arm 173*b* moves upward as represented by the arrows 205, 207, respectively. During oscillation, the sides 209 of the member 171 remain substantially parallel to the plane 197. That is, the yoke member 171 is free of undulation.

In one embodiment represented by FIG. 21, each arm 173 contacts a separate piston assembly 49 at the fill hole 57. In another, slightly-different (and more preferred) embodiment shown in FIG. 16, the yoke member 171 extends into each fill hole 57 and bears against a contact portion 109, e.g., a hold-down ball 109*a* in the piston assembly 49.

As its name suggests, the new hold-down mechanism 10*a* is effective in holding the piston shoes 111 in contact with the driving wobble plate 35. Each piston assembly 49 includes a piston 95 having a proximal end 113 with a spheroid head 211 and a piston shoe 111 contacting the wobble plate 35 and having a concave spherical surface 117 receiving the head 211. The yoke member 171 retains the shoe 111 between the head 211 and the wobble plate 35.

Figure 25:
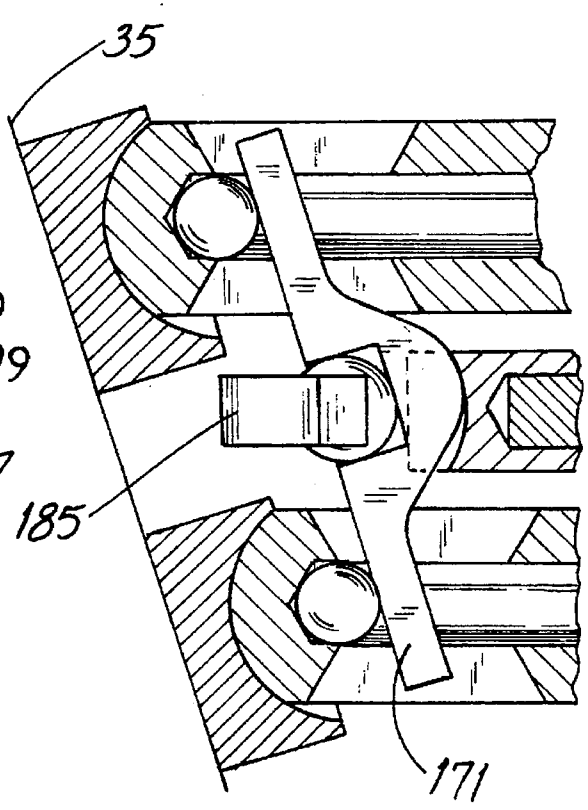
FIG. 25 is a cross-sectional side elevation view of a four-piston check valve pump incorporating a second embodiment of the inventive hold-down mechanism. Parts are broken away, cross-hatching is omitted on certain other parts and yet other parts are shown in dashed outline.

As noted in the summary, the new hold-down mechanism 10*a* may be cascaded and is not limited to use with pumps 11*a* having but two piston assemblies 163. Referring particularly to FIGS. 18 21 and 25, an exemplary pump 11*a* has a second pair 163*a* of piston assemblies 49 reciprocated in the barrel 21 by the wobble plate 35. The mechanism 10*a* further comprises a second yoke member 185 contacting the second pair 163*a* of piston assemblies 49.

In the hold-down mechanism 10*a* used with a four-piston pump 11*a*, the yoke members 171, 185 are inverted with respect to one another so that the pockets 181 of the yoke members 171, 185 face one another. The bearing 183 is interposed between the yoke members 171, 185 and, more specifically, is received in the pockets 181 and retained in position by such pockets 181.

From the foregoing, it will be appreciated that the new hold-down mechanism 10*a* has very few parts and that such parts assemble with relative ease. Notwithstanding, such mechanism 10 well performs its function of keeping the piston shoes 111 in intimate contact with the pump wobble plate 35.

While the principles of the invention are description in connection with preferred embodiments, it is to be understood clearly that such embodiments are by way of example and are not limiting.

What is claimed:

1. In a pump having (a) a wobble plate, (b) a barrel, (c) a pair of piston assemblies reciprocated in the barrel by the wobble plate, and (c) a mechanism retaining the piston assemblies in contact with the wobble plate, and wherein the barrel has a central axis, the improvement wherein the mechanism comprises:

a yoke member contacting the piston assemblies; and a support member mounted with respect to the barrel and coacting with the yoke member for permitting oscillation of such yoke member in a plane substantially coincident with the central axis;

and wherein:.

the support member has a concave surface;

the yoke member has a convex surface contacting the concave surface;

the concave surface is in a groove; and the yoke member is received in the groove.

2. The pump of claim 1 wherein:

the piston assemblies reciprocate in bores located on a bore circle; and the piston assemblies are coincident with a diameter of the bore circle.

3. The pump of claim 1 wherein:

each piston assembly includes a fill opening; and the yoke member contacts each assembly at its fill opening.

4. The pump of claim 3 wherein the yoke member extends into each fill opening.

5. The pump of claim 1 wherein:

each piston assembly includes (a) a piston having a spheroid head and (b) a piston shoe contacting the wobble plate and having a spheroid cavity receiving the head; and the yoke member retains the shoe between the head and the wobble plate.

6. The pump of claim 1 wherein (a) the pair of piston assemblies is a first pair, (b) the yoke member is a first yoke member, (c) the pump includes a second pair of piston assemblies reciprocated in the barrel by the wobble plate, and the mechanism further comprises:

a second yoke member contacting the second pair of piston assemblies; and a bearing component interposed between the yoke members.

7. The pump of claim 6 wherein:

each yoke member includes a pocket; and the bearing component is received in the pockets.

8. The pump of claim 6 wherein the yoke members are inverted with respect to one another.

9. In a pump having (a) a wobble plate, (b) a barrel, (c) a pair of piston assemblies reciprocated in the barrel by the wobble plate, and (c) a mechanism retaining the piston assemblies in contact with the wobble plate, and wherein the barrel has a central axis, the improvement wherein the mechanism comprises:

a yoke member contacting the piston assemblies; and a support member mounted with respect to the barrel and coacting with the yoke member for permitting oscillation of such yoke member in a plane substantially coincident with the central axis;

and wherein:

each piston assembly includes a fill opening; and the yoke member contacts each assembly at its fill opening.

10. In a pump having (a) a wobble plate, (b) a barrel, (c) a pair of piston assemblies reciprocated in the barrel by the wobble plate, each piston assembly having a fill opening, and (c) a mechanism retaining the piston assemblies in contact with the wobble plate, and wherein the barrel has a central axis, the improvement wherein the mechanism comprises:

a yoke member contacting the piston assemblies and extending into each fill opening; and a support member mounted with respect to the barrel and coacting with the yoke member for permitting oscillation of such yoke member in a plane substantially coincident with the central axis.

11. In a pump having (a) a wobble plate, (b) a barrel, (c) first and second pairs of piston assemblies reciprocated in the barrel by the wobble plate, and (c) a mechanism retaining the piston assemblies in contact with the wobble plate, and wherein the barrel has a central axis, the improvement wherein the mechanism comprises:

first and second yoke members contacting the first and second pairs of piston assemblies, respectively, each yoke member having a respective pocket;

a bearing component interposed between the yoke members and received in the pockets;

a support member mounted with respect to the barrel and coacting with the yoke members for permitting oscillation of such yoke members in respective planes substantially coincident with the central axis.

12. In a pump having (a) a wobble plate, (b) a barrel, (c) first and second pairs of piston assemblies reciprocated in the barrel by the wobble plate, and (c) a mechanism retaining the piston assemblies in contact with the wobble plate, and wherein the barrel has a central axis, the improvement wherein the mechanism comprises:

first and second yoke members contacting the first and second pairs of piston assemblies, respectively;

a bearing component interposed between the yoke members;

a support member mounted with respect to the barrel and coacting with the yoke members for permitting oscillation of such yoke members in respective planes substantially coincident with the central axis;

and wherein:

the yoke members are inverted with respect to one another.

* * * * *